United States Patent [19]

Seaberg

[11] 4,029,226

[45] June 14, 1977

[54] LINKAGE SUPPORT SYSTEM FOR MATERIAL HANDLING UNIT

[75] Inventor: David H. Seaberg, Davenport, Iowa

[73] Assignee: J. I. Case Company, Racine, Wis.

[22] Filed: Apr. 12, 1976

[21] Appl. No.: 675,992

[52] U.S. Cl. ..... 214/139; 214/770; 214/776

[51] Int. Cl.[2] ..... E02F 3/70

[58] Field of Search ..... 214/139, 770, 775, 776

[56] References Cited

UNITED STATES PATENTS

| | | | |
|---|---|---|---|
| 2,372,220 | 3/1945 | Mork | 214/139 |
| 2,455,474 | 12/1948 | Drott et al. | 214/770 |
| 2,538,000 | 1/1951 | Hoar et al. | 214/139 X |
| 3,074,572 | 1/1963 | Ulinski | 214/775 X |
| 3,658,202 | 4/1972 | Peterson | 214/770 |
| 3,786,953 | 1/1974 | Crum et al. | 214/776 |
| 3,872,991 | 3/1975 | Pasideris et al. | 214/770 |

*Primary Examiner*—L. J. Paperner
*Attorney, Agent, or Firm*—Dressler, Goldsmith, Clement, Gordon & Shore, Ltd.

[57] ABSTRACT

A linkage system for pivotally supporting a boom on a vehicle body with a material handling unit pivoted on the outer end of the boom through a unit fluid ram is disclosed herein. The linkage system consists of an arm that is supported for pivotal movement on the vehicle body with the boom pivoted on the arm at a spaced location. Linkage means interconnect the arm and the boom and the unit fluid ram is pivotally connected to the linkage means. The boom and body have cooperating guide means that guides the movement of the arm between first and second positions so that the moment arm is at a minimum when the boom extends generally parallel to the terrain.

4 Claims, 3 Drawing Figures

LINKAGE SUPPORT SYSTEM FOR MATERIAL HANDLING UNIT

BACKGROUND OF THE INVENTION

The present invention relates generally to material handling implements and more specifically to a material handling implement of the type wherein a material handling unit is pivotally supported on the outer end of a boom and the boom is raised and lowered for digging and dumping operations.

In conventional earth moving equipment, such as bucket loaders, the machinery generally consists of one or more lift arms that define a boom and are pivotally carried on a vehicle with a bucket pivoted on the outer free end of the lift arms. Generally, the lift arms are raised and lowered with respect to the vehicle by a boom fluid motor while the material handling unit or bucket is pivoted on the end of the lift arms through a unit fluid motor both of which have fluid supplied thereto through control valves.

SUMMARY OF THE INVENTION

According to the present invention, there is provided an improved linkage system for supporting the boom on the vehicle body of a material handling implement in a manner that the moment arm for the material handling unit on the outer end of the boom is varied as the boom is raised and lowered.

The above is accomplished by an arm which is pivotally supported on the body and has the boom pivotally supported thereon with the two pivots being spaced from each other. A unit fluid ram is supported by linkage means that are interposed between the arm and the boom so that the material handling unit is automatically maintained at a level condition during the raising of the boom from a filling position to a dumping position. The boom and vehicle body have cooperating guide means which automatically move the arm and the boom pivot between first and second positions so that the moment arm for the material handling unit is at a minimum in an intermediate position where the boom extends generally parallel to the terrain and this moment arm is at a maximum condition when the boom is at extreme lowered or an extreme raised position.

The guide means accomplishing the above consists of an elongated slot in the vehicle body that is angularly located with respect to a vertical plane extending through the boom pivot as well as a horizontal plane extending through the boom pivot while the cooperating element consists of a roller that is supported on the boom and is in rolling contact in the slot.

The linkage system also incorporates lock means to interlock the arm and the vehicle body so that the boom is pivoted about a fixed position with respect to the vehicle body.

DETAILED DESCRIPTION

Figure 1:
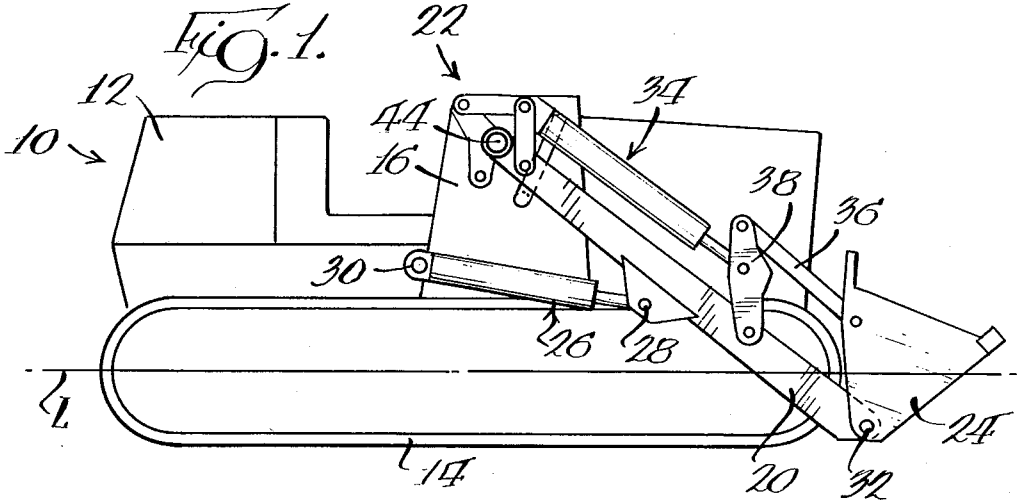
FIG. 1 shows a side elevation view of a material handling implement having the present invention incorporated therein.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings discloses a material handling implement, generally designated by the reference numeral 10. Material handling implement 10 consists of a vehicle having a vehicle body 12 that is supported on ground engaging members 14 (only one being shown) while body 12 has a pair of vertically extending uprights 16 located on opposite sides thereof (only one being shown). Since most of the parts to be described hereafter are duplicated on opposite sides of the vehicle, only one part will be described with an understanding that the vehicle has an identical part on the opposite side of vehicle body 12 and supported on the second upright 16.

Vehicle body 12 has a lift arm or boom 20 that is pivotally supported on upright 16 through a linkage system 22, that will be described later, while the outer end of the boom 20 has a material handling unit 24, such as a bucket, pivoted thereon. Boom 20 is pivoted between raised and lowered positions with respect to vehicle body 12 through a fluid ram 26 that has one end connected by a pivot pin 28 to boom 20 while the opposite end is connected by a pivot pin 30 to vehicle body 12. Bucket or material handling unit 24 is pivoted about its pivotal connection 32 by a unit fluid ram 32 that has one end connected to bucket 24 through first and second links 36 and 38 that are interconnected to each other and have free ends respectively connected to the bucket and the boom. This linkage system is common in the art and no detailed description thereof appears to be necessary.

According to the present invention, the rear end of the boom, defined by the two lift arms 20 is pivotally supported on the vehicle by the linkage system 22 so that the pivot for the boom is moved between two positions as the material handling unit is being raised and lowered.

More specifically, linkage system 22 consists of an arm 40 (FIG. 2) that is pivotally supported by a pin 42 on upright 16 which forms part of vehicle body 12. Boom 20 has one end pivotally supported on arm 40 through a pivot pin 44 which is spaced from pivot pin 42 and is located intermediate opposite ends of arm 40. The linkage system also includes linkage means consisting of first and second links 50 and 52 that have one end pivotally connected to each other through a pivot pin 54 and have the opposite ends respectively pivotally connected to boom 20 through a pivot pin 56 and to arm 40 through a pivot pin 58. The cylinder end or first element of fluid ram 34 is connected to the pivot pin 54 interconnecting links 50 and 52 and the piston rod or second element is connected to link 38.

Cooperating guide means 60 are located between upright 16 and boom 20 to guide the boom along a predetermined path during the raising and lowering thereof. Guide 60 consists of an elongated slot 62 that is defined in upright 16 with a guide member or roller 64 rotatably supported on a bracket 66 that extends from the lower edge of boom 20.

Figure 2:
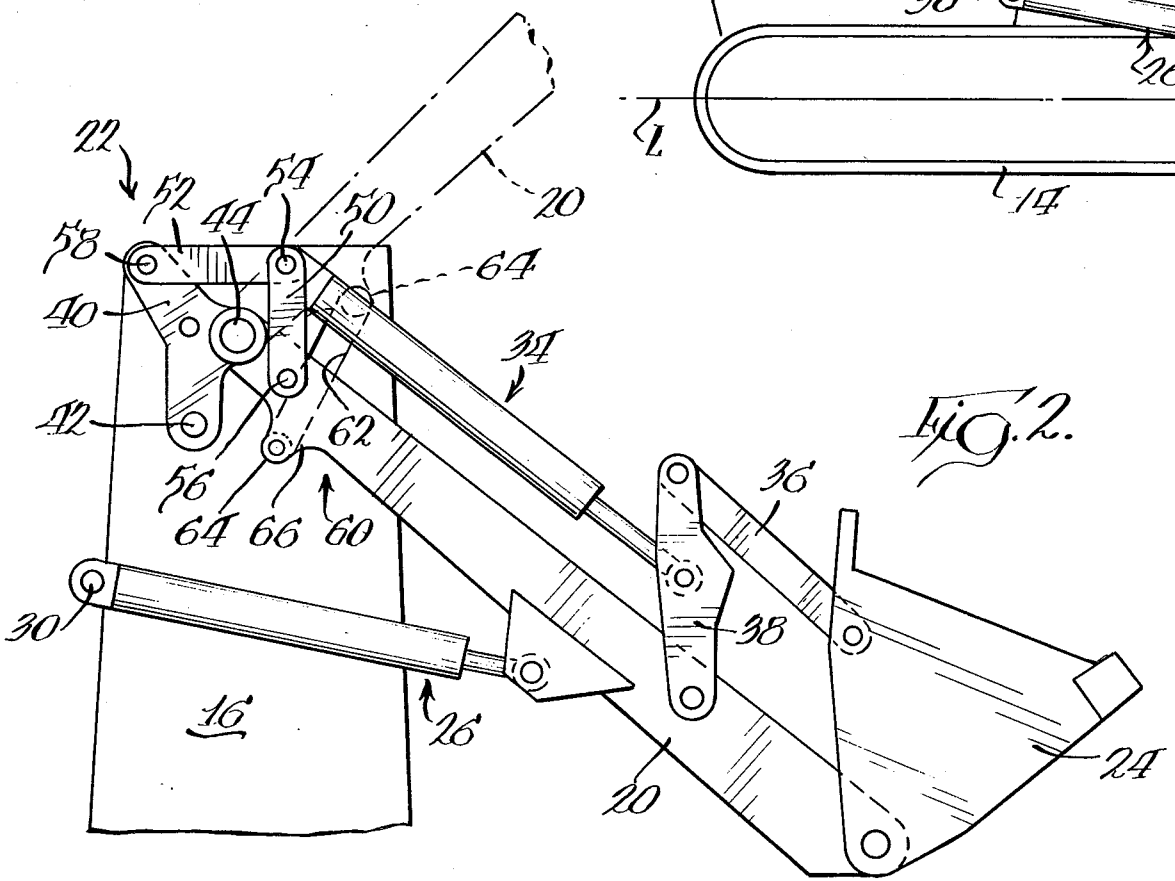
FIG. 2 is a fragmentary view similar to FIG. 1 showing the details of the linkage system of the present invention.
Figure 3:
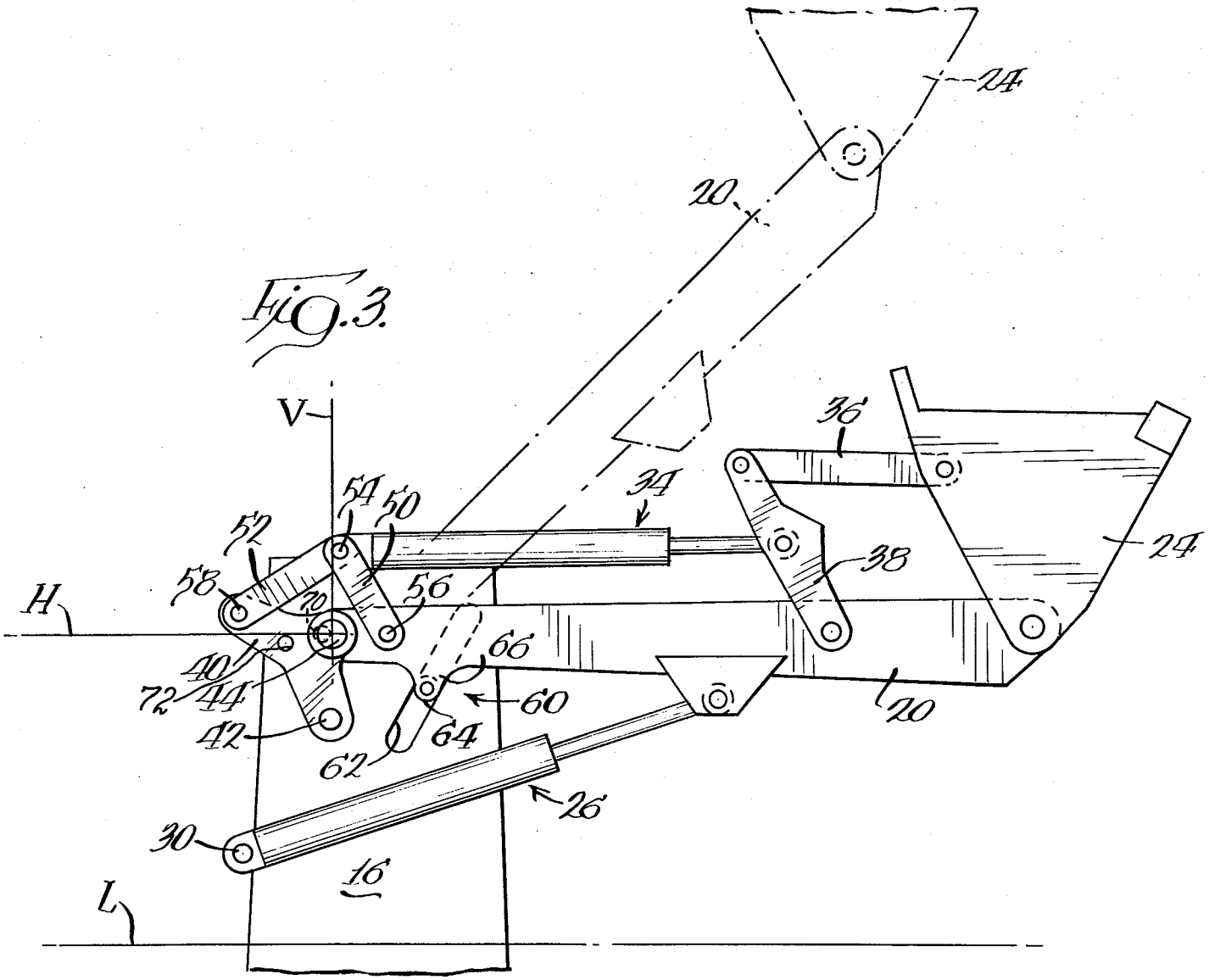
FIG. 3 is a view similar to FIG. 2 showing the position of the linkage system when the boom is at an intermediate position.

Slot 62 is configured so as to move arm 40 from the position illustrated in FIG. 1 to the position illustrated in FIG. 2 while boom 20 and material handling unit 24 are pivoted from the lowermost position illustrated in FIG. 2 to an intermediate position illustrated in FIG. 3 wherein boom 22 extends generally parallel to a longitudinal axis L (FIG. 1) for vehicle body 12. A comparison of FIGS. 2 and 3 will show that the pivot pin 44 is located a substantial distance rearwardly with respect to vehicle body 12 in the intermediate position (FIG. 3) than it is in the lowermost position illustrated in FIG. 2. This means that the material handling unit or bucket 24, which is suspended in cantilevered position on the outer end of boom 20 is located substantially closer to the center of gravity for vehicle body 12 to thereby reduce the moment arm for material handling unit 24 with respect to the center of gravity of the vehicle. This reduction in moment arm for material handling unit or bucket 24 in the intermediate position substantially increases the stability of the unit when a full load is being transported by the vehicle. In other words, the movement of the material handling unit towards the vehicle as the boom is moved between the lowered and the intermediate position enhances the resistance to tipping of the vehicle when a full load is being carried in bucket 24.

As indicated above, slot 62 is configured so as to again move the material handling unit away from vehicle body 12 as the implement is raised above the intermediate position to a maximum raised position illustrated in dotted lines in FIG. 2. Stated another way, the arm 40 is moved from the second position illustrated in FIG. 3 to the first position illustrated in FIG. 2 while the material handling unit 24 is moved from the intermediate position to a maximum raised position, illustrated in phantom line in FIG. 2. An inspection of FIG. 3 shows that slot 62 defines an angle of approximately 30° with respect to vertical plane V through pin 44 and an angle of approximately 60° with respect to horizontal plane H through pin 44. This angle can be varied or the slot can be curved to obtain different characteristics for the path of movement of bucket 24.

The above arrangement has the advantage of having a maximum reach for the material handling unit at the extreme lowermost position and at the extreme raised position while still reducing the moment arm for a material handling unit in an intermediate position wherein the bucket is normally the greatest distance away from the center of gravity for the vehicle.

The vehicle also has lock means for locking arm 40 in a fixed position on the vehicle body so that the boom is pivoted about a fixed pivot with respect to the vehicle body while moving between raised and lowered positions. In the illustrated embodiment, the lock means includes openings 70 and 72 (FIG. 3) respectively on upright 16 and arm 40. As shown in FIG. 2, these openings are aligned when arm 40 is in the first extreme position so that a bolt (not shown) can be received through the openings to lock arm 40 on upright 16. Of course, roller 64 would have to be removed to allow boom 20 to pivot about fixed pivot 44 when arm 40 is locked on upright 16.

The unique linkage system also has improved "roll-back and leveling characteristics." That is to say from an inspection of FIGS. 2 and 3 it will be noted that the pivotal connections 56 and 58 for linkage means 50, 52 generally move as arm 40 and boom 20 are moved between the two positions. This will cause bucket 24 to move from the slight angular position illustrated in FIG. 2 to a generally horizontal position illustrated in FIG. 3. Also, as the material handling unit 24 is moved from the intermediate position to the extreme raised position, the linkages 50 and 52 are also moved so that the material handling unit is maintained generally level or at the same angular attitude with respect to the longitudinal axis L.

As can be appreciated from the above description, the present invention provides a unique simple linkage system that can be incorporated into existing machinery at a minimum cost and substantially increase the resistance of the vehicle to tipping during a normal loading operation.

What is claimed is:

1. In a material handling implement including a vehicle body, a boom pivotally supported on one end on said body with a boom fluid ram between said body and boom for pivoting said boom and a material handling unit pivoted on a free end of said boom by a unit fluid ram, the improvement comprising an arm supported on said body by a first pivot with said boom supported on said arm by a second pivot spaced from said first pivot; linkage means including first and second links pivotally interconnected at one end, said first link having an opposite end connected to said arm by a third pivot spaced from said first and second pivots and said second link having an opposite end connected to said boom at a location spaced from said second pivot, said unit fluid ram including a first element pivotally connected to said one end of said first and second links and a second element operatively connected to said material handling unit; and guide means between said body and said boom for guiding said boom during pivotal movement thereof, said guide means and pivots being positioned to pivot said arm between first and second extreme pivoted positions with said material handling unit being moved toward said vehicle as said arm is moved from said first extreme position toward said second extreme position, said arm being in said second extreme position when said boom is at an intermediate position generally parallel to a longitudinal axis of said vehicle body to minimize the moment arm for said boom at said intermediate position, said links being configured to maintain said material handling unit generally at the same angular attitude as said boom is moved from an extreme lower position to an extreme raised position.

2. A material handling implement as defined in claim 1, in which said arm is in said first extreme position when said boom is at an extreme lowered position and at an extreme raised position.

3. A material handling implement as defined in claim 2, in which said vehicle body has an elongated slot with said boom having a guide member fixed thereto and received in said slot to define said guide means, said slot being configured to move said arm from said first position to said second position while said boom is moved from the extreme lower position to the intermediate position and move said arm from said second position to said first position while said boom is moved from the intermediate to the extreme raised position.

4. A material handling implement as defined in claim 1, further including lock means between said arm and said body for interconnecting said arm and body so that said second pivot is fixed with respect to said body while said boom is moved between extreme positions.

* * * * *